US006119607A

United States Patent [19]

Guy et al.

[11] Patent Number: 6,119,607

[45] **Date of Patent: *Sep. 19, 2000**

[54] GRANULAR BED PROCESS FOR THERMALLY TREATING SOLID WASTE IN A FLAME

[75] Inventors: Christophe Guy, Montréal; Robert Legros, Kirkland; Jamal Chaouki, Pointe-Claire; René-Jean Lavallée, Montréal, all of Canada; Luc Bussac, Eyragues; Luc Mauillon, St-Denis, both of France; Lukanda Mukadi, Montréal, Canada

[73] Assignee: Corporation de l'Ecole Polytechnique, Quebec, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/853,694

[22] Filed: May 9, 1997

[51] Int. Cl.[7] ..... F23G 5/00; F23G 5/30; F23C 10/00

[52] U.S. Cl. ..... 110/346; 110/245; 110/342; 110/347; 110/348; 431/7; 432/14

[58] Field of Search ..... 110/235, 245, 110/244, 341, 342, 344, 346, 347, 348; 122/4 D; 431/159, 170, 2, 4, 7; 432/14, 15, 16, 30, 31; 165/104.16, 104.18

[56] References Cited

U.S. PATENT DOCUMENTS

| | | | |
|---|---|---|---|
| 2,698,171 | 12/1954 | Schoenmakers et al. . | |
| 3,119,379 | 1/1964 | Sweeney et al. | 122/4 |
| 3,215,505 | 11/1965 | Schmalfeld et al. . | |
| 3,495,654 | 2/1970 | Jacubowiez | 165/104.16 |
| 4,064,018 | 12/1977 | Choi | 201/12 |
| 4,240,377 | 12/1980 | Johnson | 122/4 D |
| 4,359,005 | 11/1982 | Baston | 110/245 |
| 4,507,081 | 3/1985 | Deve | 432/106 |
| 4,565,328 | 1/1986 | Deve | 241/65 |
| 4,566,637 | 1/1986 | Deve | 241/23 |
| 4,573,417 | 3/1986 | Deve | 110/236 |
| 4,738,615 | 4/1988 | Bailey et al. | 432/15 |
| 4,757,771 | 7/1988 | Narisoko et al. | 110/245 |
| 4,871,147 | 10/1989 | Muschelknautz et al. | 266/182 |
| 4,917,027 | 4/1990 | Albertson et al. | 110/346 |
| 4,934,282 | 6/1990 | Asai et al. | 110/244 |
| 4,938,156 | 7/1990 | Yahata | 110/346 |
| 4,947,803 | 8/1990 | Zenz | 122/4 D |
| 4,960,057 | 10/1990 | Ohshita et al. | 110/345 |
| 4,974,531 | 12/1990 | Korenberg | 110/346 |
| 4,979,448 | 12/1990 | Sheely et al. | 110/346 |

(List continued on next page.)

FOREIGN PATENT DOCUMENTS

| | | |
|---|---|---|
| 0 224 353 | 3/1987 | European Pat. Off. . |
| WO 79/00009 | 1/1979 | WIPO . |

*Primary Examiner*—Ira S. Lazarus
*Assistant Examiner*—Ljiljana V. Ciric
*Attorney, Agent, or Firm*—Darby & Darby

[57] ABSTRACT

The process is conducted in an incinerator installation comprising i) a generally vertical, cylindrical riser pipe, ii) a vertically extending annular chamber surrounding the riser pipe and containing a fluidized bed of granular inert material, and iii) a burner for producing an upwardly extending flame in the lower portion of the riser pipe. Granular solid waste is supplied at a constant flow rate to the bed, directly or through the burner. Granular solid waste and bed material is transferred from the lower portion of the annular chamber to the lower portion of the riser pipe directly in the flame. The flame burns the granular solid waste, heats the inside of the riser pipe to a temperature greater than or equal to 900° C., and produces flue gas that pneumatically transports the granular solid waste and bed material upwardly from the lower portion to the upper end of the riser pipe at a speed of 3–15 m/s to create a high turbulence thereby increasing absorption of heat by the granular solid waste and oxidation of the organic components of the granular solid waste. The granular solid waste and bed material is discharged in the annular chamber through the upper end of the riser pipe, treated granular solid waste is collected from the fluidized bed to maintain the height of granular solid waste and bed material substantially constant, and flue gas is evacuated.

12 Claims, 1 Drawing Sheet

U.S. PATENT DOCUMENTS

| | | | |
|---|---|---|---|
| 4,998,486 | 3/1991 | Dighe et al. | 110/346 |
| 5,022,329 | 6/1991 | Rackley et al. | 110/234 |
| 5,033,413 | 7/1991 | Zenz et al. | 122/4 D |
| 5,042,964 | 8/1991 | Gitman | 432/13 |
| 5,158,449 | 10/1992 | Bryan et al. | 432/15 |
| 5,159,885 | 11/1992 | Hasebe et al. | 110/346 |
| 5,353,718 | 10/1994 | Warchol et al. | 110/237 |
| 5,365,889 | 11/1994 | Tang | 122/4 D |
| 5,379,705 | 1/1995 | Takada et al. | 110/245 |
| 5,400,725 | 3/1995 | Brännström | 110/245 |
| 5,439,045 | 8/1995 | Crafton | 164/5 |
| 5,543,117 | 8/1996 | Kitto, Jr. | 422/145 |
| 5,772,708 | 6/1998 | Froehlich | 110/245 X |

GRANULAR BED PROCESS FOR THERMALLY TREATING SOLID WASTE IN A FLAME

BACKGROUND OF THE INVENTION

1. Field of the Invention

The present invention relates to a process and incinerator installation for thermally treating with a high-efficiency granular solid waste.

In the present specification and in the appended claims, the term "granular solid waste" is intended to include also granular solid waste having a high humidity content, such as granulated sludge.

2. Brief Description of the Prior Art

Burial of urban and industrial solid waste is less and less supportable on the economic and environmental points of view. Burial of solid waste and sludge is an expensive operation whose cost can be reduced through valorization of such waste before landfilling the unusable portion. Competitiveness and profitability of certain industries are closely related to the valorization, regeneration and efficient treatment of solid waste. Recent governmental regulations are more restrictive regarding the burial of solid waste without close control of the landfill leachate. Waste burial, when permitted, is more and more expensive due to control requirements (cellular burial, stabilization, etc.). Accordingly, it is urgent to consider any waste as a potential source of energy or even as a potential source of raw material.

The rigor of recent laws and regulations reflects the increasing concern of the population regarding the quality and protection of the environment. This is presently leading to the development of more versatile and performing technologies having a high destruction capability. The governmental policies initiated by the American Environment Protection Agency (EPA), are more and more oriented toward the promotion of the "best available technology". Such policies get around the problem of having to estimate the real level of risk for the environment and/or the health of the population associated to the operation of a given technology. In any case, this level of risk is very difficult to estimate.

These concerns and the continuously increasing volume of solid waste to be treated have resulted in the new challenge of developing processes capable of valorizing, regenerating and treating solid waste. Many approaches are available for treating solid waste: physical, thermal, biological and mechanical treatments. The approach to be used for a given application depends on many factors: the type of waste to be treated, the composition (fraction of organic matter, water, inert matter, etc.), the quantity, the size, the type of bond between the components of the waste, etc. The approach to be selected also strongly depends on the objectives of the treatment: elimination or degradation of an hazardous product, stabilization, recycling, energetic valorization, decontamination, volume reduction, etc.

An approach is selected in relation to its technical and economical performance. For example, energy recovery options are widely used in relation to solid waste having average or high organic contents. Energy recovery can be divided into three categories: incineration, gasification and pyrolysis. Selection of one or the other of these three categories depends on whether one wishes to conduct a direct valorization through heat recovery or an indirect valorization through production of combustible.

Incineration is recognized as the most interesting approach in several applications: the existing incineration technologies offer good technical, economical and environmental performance. Incineration can substantially reduce the volume of solid waste and a recovery of energy from the flue gas. In many situations, it can eliminate the contaminants and regenerate or valorize the solid waste being treated.

Application of the existing incineration technologies is limited since none of these technologies is capable of solving all the problems related to elimination and valorization of the solid waste; each case requiring its own solution. Moreover, many of the existing incineration technologies present the following drawbacks:

atmospheric pollution (displacement of the pollution);

low capacity;

low versatility; and high investment and operation costs.

In order to meet the new requirements related to the quality of treatment, several technologies have been developed or are presently being developed; these technologies operate at high temperature to convert large amounts of organic matter.

OBJECT OF THE INVENTION

An object of the present invention is therefore to provide an efficient process and apparatus for thermally treating with a high efficiency and at high temperature granular solid waste in view of eliminating contaminants, regenerating and/or valorizing such solid waste, etc.

SUMMARY OF THE INVENTION

More specifically, in accordance with the present invention, there is provided a process for thermally treating granular solid waste in an incinerator installation comprising i) a generally vertical riser pipe having an inside, an upper end, and a lower portion, ii) a vertically extending chamber adjacent to the riser pipe, having a lower portion, and containing a bed of granular material, and iii) a burner for producing an upwardly extending flame in the lower portion of the riser pipe and flue gas flowing upwardly in the riser pipe. The process according to the invention comprises the steps of:

a) supplying granular solid waste to the bed;

b) supplying granular solid waste and bed material from the lower portion of the chamber to the lower portion of the riser pipe directly in the flame;

c) by means of the flame produced by the burner, burning the granular solid waste and heating the inside of the riser pipe;

d) by means of the flue gas, pneumatically transporting the granular solid waste and bed material upwardly from the lower portion of the riser pipe to the upper end of that pipe so as to create turbulence in the riser pipe to thereby increase absorption of heat by the granular solid waste and oxidation of combustible components of the granular solid waste;

e) discharging the granular solid waste and bed material in said chamber through the upper end of the riser pipe; and f) evacuating the flue gas from the incinerator installation.

The flue gas may then be treated, if necessary, by means of appropriate air pollution control systems.

Also in accordance with the present invention, there is provided an incinerator installation for thermally treating granular solid waste, comprising i) a generally vertical riser pipe having an inside, an upper end, and a lower portion, ii) a vertically extending chamber adjacent to the riser pipe, having a lower portion, and containing a bed of a granular material, iii) means for supplying granular solid waste to the bed, iv) means for transferring granular solid waste and bed material from the lower portion of the chamber to the lower portion of the riser pipe, v) a burner for producing a) an upwardly extending flame in the lower portion of the riser pipe to heat the inside of the riser pipe, wherein the transferring means comprises means for injecting the granular solid waste and bed material from the lower portion of the chamber directly into the flame to burn the granular solid waste, and b) flue gas to pneumatically transport the granular solid waste and bed material upwardly from the lower portion of the riser pipe to the upper end of the pipe whereby turbulence is created in the riser pipe to increase absorption of heat by the granular solid waste, vi) means for discharging the pneumatically transported granular solid waste and bed material in the chamber through the upper end of the riser pipe, vii) means for collecting treated granular solid waste from the chamber, and viii) means for evacuating the flue gas produced by the burner.

Supply of the granular solid waste directly in the flame and the turbulence produced by the upward pneumatic transport increases the efficiency of the treatment. This results into an improved combustion, an improved oxidation of the organic components, and a reduced emission of pollutants.

Granular solid waste may be supplied to the bed at a given flow rate, and the process may comprise a step of collecting treated granular solid waste from the chamber in order to maintain a level of granular solid waste and bed material substantially constant. Granular solid waste may be supplied directly in the chamber on the top of the bed or through the burner.

In accordance with a preferred embodiment, the chamber is generally annular and surrounds the riser pipe, supply of air in the lower portion of the annular chamber causes supply of granular solid waste from the lower portion of the annular chamber to the lower portion of the riser pipe and a downward flow of granular solid waste and bed material in the annular chamber, and the process further comprises the step of transferring heat from the inside of the riser pipe to the annular chamber to heat and/or dry the granular solid waste as this granular solid waste flows downwardly in the annular chamber.

Preferably, the lower portion of the riser pipe comprises orifices through which granular solid waste and bed material from the lower portion of the annular chamber is transferred to the lower portion of the riser pipe directly in the flame.

In accordance with preferred embodiments:

- the reactor is a fast fluidized bed with inner circulation;
- the inside of the riser pipe is raised to a temperature ≧900° C.;
- the granular solid waste and bed material is transported upwardly in the riser pipe at a speed between 3 and 15 meters/second; and
- the volume fraction of granular solid waste and bed material in the riser pipe is situated between 1% and 5% to further increase its velocity and the turbulence in the riser pipe.

The objects, advantages and other features of the present invention will become more apparent upon reading of the following non restrictive description of a preferred embodiment thereof, given by way of example only with reference to the accompanying drawing.

DETAILED DESCRIPTION OF THE PREFERRED EMBODIMENT

Figure 1:
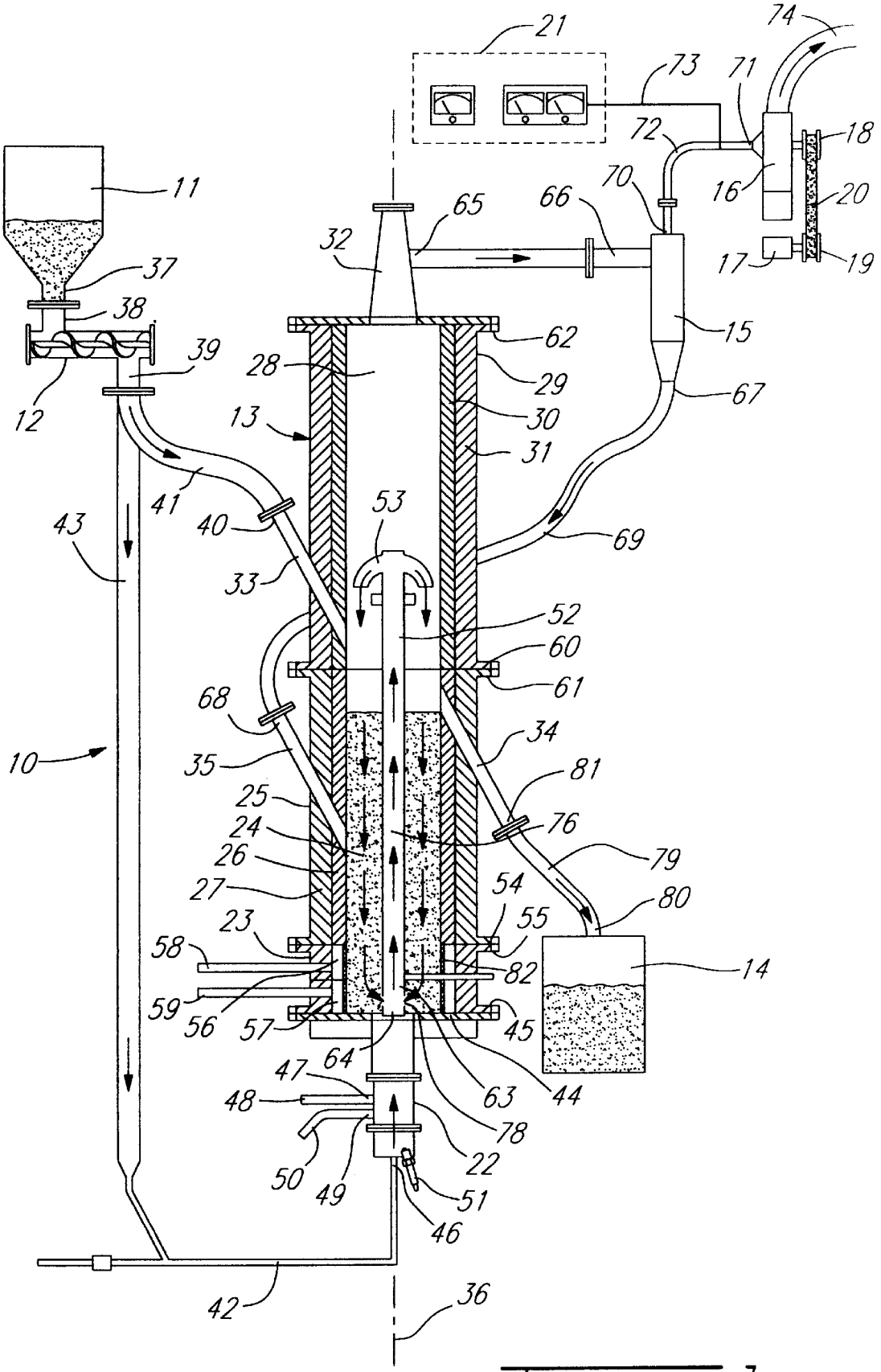
FIG. 1 is a schematic, partially cross sectional front elevational view of an incinerator installation in accordance with the present invention, for thermally treating granular solid waste.

Referring to FIG. 1 of the appended drawing, the preferred embodiment of the incinerator installation is generally identified by the reference 10.

As shown in appended FIG. 1, the incinerator installation 10 comprises:

- a hopper 11 for containing granular solid waste to be thermally treated;
- a screw conveyor 12;
- a fast fluidized bed incinerator 13 with inner circulation;
- a reservoir 14 for collecting thermally treated solid waste from the fluidized bed incinerator 13;
- a cyclone separator 15;
- an optional blower 16 driven by an electric motor 17 through a pair of pulleys 18 and 19 (alternatively a pair of toothed wheels), and a belt 20 (alternatively a chain); and
- an optional flue gas analyser 21.

Still referring to FIG. 1, the fluidized bed incinerator 13 comprises:

- a burner 22;
- a cylindrical, secondary air distributor 23;
- a lower cylindrical member 25 comprising an inner wall 26 and an outer wall 27;
- an upper cylindrical member 29 having an inner wall 30 and an outer wall 31 (it should be pointed out that the lower 25 and upper 29 cylindrical members can be replaced by a single, longer cylindrical member or a series of more than two cylindrical members);
- a generally vertical, cylindrical and central inner riser pipe 52 having an upper end formed with a fountain 53;
- a top cap 32;
- an annular chamber 24 formed between a) the riser pipe 52 and b) the secondary air distributor 23 and the lower 25 and upper 29 cylindrical members;
- an upper chamber 28 delimited by the upper cylindrical member 29 between the fountain 53 and the top cap 32;
- a first downwardly sloping inlet tube 33 communicating with the top portion of the annular chamber 24;
- a downwardly sloping outlet tube 34 communicating with the upper portion of the annular chamber 24;
- a second downwardly sloping inlet tube 35 generally situated at mid-height of the lower cylindrical member 25.

The inner walls 26 and 30, being in contact with the flue gas and/or solid particles are made of heat-insulating and attrition-resistant material. The material of the outer walls 27 and 31 is more heat-insulating but less attrition-resistant than the material of the inner walls 26 and 30.

As shown in FIG. 1, the burner 22, the cylindrical secondary air distributor 23, the lower cylindrical member 25, the upper cylindrical member 29, the cylindrical, central inner riser pipe 52, and the top cap 32 are all coaxial about a vertical axis 36.

Still referring to FIG. 1, the hopper 11 has an outlet 37 connected to an inlet 38 of the screw conveyor 12. The screw conveyor 12 has itself an outlet 39 connected to the outside, upper end 40 of the inlet tube 33 through a line 41. The outlet 39 of the screw conveyor 12 is also connected to a conveying air supply line 42 through a line 43.

The burner 22 comprises a base member 44 secured to a lower annular flange 45 of the secondary air distributor 23. It comprises an axial, conveying air inlet 46 connected to the conveying air supply line 42, a radial, primary air inlet 47 connected to a primary air supply line 48 (air being the oxidizing agent supplied to the burner 22), and a radial combustible gas inlet 49 connected to a combustible gas supply line 50. A spark plug 51 is also provided to ignite the burner 22.

The cylindrical, secondary air distributor 23 is formed with an upper 56 and a lower 57 annular cavities communicating with the inside of distributor 23 through perforations such as 82. The upper annular cavity 56 is supplied with pressurized air through a secondary air supply line 58, while the lower annular cavity 57 is supplied with pressurized air through a secondary air supply line 59.

The lower cylindrical member 25 has a lower annular flange 54 connected to an upper annular flange 55 of the air distributor 23, the upper cylindrical member 29 has a lower annular flange 60 connected to an upper annular flange 61 of the lower cylindrical member 25, and the top cap 32 is connected to an upper annular flange 62 of the upper cylindrical member 29.

The riser pipe 52 has a lower portion 63 situated in the vicinity of the outlet 64 of the burner 22 whereby an upwardly extending flame (not shown) is produced within the riser pipe 52 in the lower portion 63 thereof. Also, the lower portion 63 of the riser pipe 52 comprises orifices such as 78 to allow granular solid waste and bed material to flow from the annular chamber 24 to the lower portion 63 of this riser pipe 52.

The top cap 32 has an outlet 65 connected to an inlet 66 of the cyclone separator 15. This separator 15 has also a solid particle outlet 67 connected to the upper, outside end 68 of the inlet tube 35 through a line 69. Moreover, separator 15 has a gas outlet 70 connected to an inlet 71 of the blower 16 through a line 72.

The blower 16 is connected to a gas evacuation line 74. Flue gas flowing through the line 72 is supplied to the analyser 21 through a line 73.

Finally, the reservoir 14 for collecting thermally treated granular solid waste has an inlet 80 connected to the outside, lower end 81 of the outlet tube 34 through a line 79.

Operation of the incinerator installation will now be described.

Still referring to FIG. 1 of the appended drawings, the fluidized bed incinerator 13 defines three distinct zones:

- the above mentioned annular chamber 24 between a) the cylindrical members 25 and 29 and the secondary air distributor 23, and b) the riser pipe 52;
- a central zone 76 inside the riser pipe 52; and
- a disengagement zone (upper chamber 28) delimited by the upper cylindrical member 29 between the fountain 53 and the top cap 32.

Initially, the annular chamber 24 of the incinerator 13 contains a bed of inert, solid granular material, for example sand or ash.

Granular solid waste to be treated is stocked into the hopper 11 and is transferred to the incinerator 13, at a given flow rate, by the screw conveyor 12. Depending on the type of solid waste to be treated, the two following alternatives are available to supply granular solid waste from the screw conveyor 12 to the bed inside the incinerator 13:

a) The solid waste may be injected directly into the annular chamber 24 on the top of the bed of granular material through the line 41 and the inlet tube 33. The injected granular solid waste then flows downwardly along with the granular bed material. This downward flow enables heat produced by the burner 22 in the riser pipe 52 and conducted through the wall of the riser pipe 52 to pre-heat and/or dry (when it contains humidity) the injected granular solid waste.

b) The granular solid waste from the screw conveyor 12 may be supplied directly to the burner 22 through the conveying air supply line 42. The conveying air flowing through the line 42 pneumatically displaces the solid waste toward the axial inlet 46 of the burner 22. The solid waste injected directly into the burner subsequently flows upwardly in the riser pipe 52 along with the flue gases and is discharged in the annular chamber on the bed through the upper end of the riser pipe 52 and the fountain 53.

The bed of granular material in the annular chamber 24 can be fluidized or not depending on the particular application. Supply of pressurized air through the lines 58 and 59, the annular cavities 56 and 57, and the perforations 82 is adjusted to ensure a displacement of granular material through the orifices 78. If enough air is supplied, the bed in the annular chamber 24 can be fluidized. Granular solid waste and bed material is transferred from the lower portion of the annular chamber 24 to the lower portion of the riser pipe 52 through the perforations 78 directly in the flame produced by the burner 22.

Different types of burners can be used as burner 22. However, if granular solid waste has to be transferred from the screw conveyor 12 to the burner 22 as described hereinabove, the type of burner selected must be capable of delivering granular solid waste within the flame; in this case burners comprising mechanical pieces which do not enable passage of granular solid waste cannot be used. The burner 22 can be a burner supplied with gaseous, liquid or solid combustible and with any type of oxidizing agent.

The rate of flow of granular solid waste and bed material from the lower portion of the annular chamber 24 to the lower portion 63 of the riser pipe 52 (central zone 76) through the orifices 78 is related to the following parameters:

- the height of granular solid waste and bed material in the annular chamber 24;
- the diameter of the orifices 78 in the lower portion 63 of the riser pipe 52;
- the superficial velocity of the flue gas in the riser pipe 52; and
- the flow rate of secondary air supplied in the lower portion of the annular chamber 24 through the annular cavities 56 and 57 and the perforations 82.

The level of granular solid waste and bed material in the annular chamber 24 must be sufficiently high to maintain a positive pressure between the annular chamber 24 and the central zone 76 (riser pipe 52) in the region of the orifices 78 to prevent transfer of flue gas from zone 76 to the annular chamber 24.

The granular solid waste penetrating the riser pipe 52 through the orifices 78 passes within the flame (not shown) produced by the burner 22 and is accelerated upwardly by the flue gas to reach the upper end of the riser pipe 52 where it is ejected in the disengagement zone (upper chamber 28).

The upper end of the riser pipe 52 can be equipped, as illustrated, with the fountain 53 to deviate the solid particles toward the bed in the annular chamber 24 and thereby expedite the gas/solid disengagement. The fountain 53 can be replaced by an impact plate or any other obstacle capable of deviating the solid particles downwardly.

The cycle (annular chamber 24-orifices 78-flame-riser pipe 52-fountain 53-annular chamber 24) is repeated by the granular solid waste a certain number of times. Granular solid waste and granular bed material then exits the annular chamber 24 by overflow through the outlet tube 34 and is collected in the reservoir 14 through the line 79. Thermally treated granular solid waste can also be drawn directly from the bed in the annular chamber 24. The residence time of the particles of solid waste in the incinerator 13 is statistically distributed around a mean residence time and depends on the rate of flow of the granular solid waste being supplied to the incinerator 13 and the inventory of bed material in that incinerator 13.

When the treatment of the granular solid waste produces little non-combustible ash, the bed is formed of a granular inert material such as sand. In this particular case, little granular treated solid waste and bed material is drawn out of the annular chamber 24 through the outlet tube 34.

When the treatment of the granular solid waste produces a substantial amount of non combustible ash (for example foundry sand in which only 1% of the mass is combustible), the bed is formed with ash from the solid waste. In this particular case, only solid waste ashes are recovered. A quantity of granular treated solid waste (foundry sand free of organic resin) almost equal to the quantity of contaminated foundry sand supplied to the incinerator 13 is drawn out of the annular chamber 24 through the outlet tube 34.

When the treatment of the granular solid waste produces a reasonable (average) quantity of non combustible ash (for example paper de-inking sludge), addition of granular inert material such as sand to the bed is desirable to ensure that the bed contains a sufficient amount of granular solid material. In this particular case, solid waste ash and sand is recovered. Since a certain quantity of sand is drawn out of the annular chamber 24 through the outlet tube 34, sand must be supplied in the annular chamber to make up the bed.

The flue gas in the disengagement zone (upper chamber 28) is directed toward the cyclone separator 15 in which the fine particles in suspension in the flue gas are separated from the gas and returned to the bed in the annular chamber 24 of the incinerator 13 through the line 69 and the inlet tube 35. The flue gas from the cyclone separator 15 is analysed by the analyser 21 before being evacuated through the blower 16 and line 74. The blower 16 creates a low negative pressure so as to prevent leakage of flue gas in the incinerator installation.

To obtain better efficiency in thermally treating the granular solid waste, the following physical parameters:

- the diameter of the riser pipe 52;
- the diameter of the lower 25 and upper 29 cylindrical members;
- the level (height) of granular solid waste and bed material in the annular chamber 24;
- the diameter of the orifices 78;
- the flow rate of secondary air injected laterally in the lower portion of the annular chamber 24 through the annular cavities 56,57 and the perforations 82; and
- the temperature, volume and length of the flame produced by the burner 22;

are adjusted to obtain the following conditions of operation:

- supply of the granular solid waste and bed material in the riser pipe directly into the flame produced by the burner 22;
- an upward pneumatic transport of granular solid waste and bed material in the riser pipe 52 at a velocity between 3 and 15 meters/second (between 10 and 50 feet/second);
- a low volume fraction of granular solid waste and bed material in the riser pipe 52 situated between 1% and 5%; and
- a temperature ≧900° C. over the entire length of the riser pipe 52.

Supply of the granular solid waste and bed material directly within the flame improve combustion of the granular solid waste. Also, supply of the granular solid waste and bed material directly within the flame, upward pneumatic transport of the granular solid waste and bed material in the riser pipe 52 at a speed between 3 and 15 meters/second (between 10 and 50 feet/second), the low volume fraction of the granular solid waste and bed material in the riser pipe 52 (between 1% and 5%) contribute to increase the velocity of the granular solid waste and bed material and to create a high turbulence in the riser pipe 52 thereby increasing the thermal exchange coefficient to i) improve combustion of the granular solid waste, ii) increase oxidation of the combustible, organic components of the granular solid waste and iii) reduce emission of pollutants whereby any subsequent treatment destined to reduce such emission may be no longer required.

| First example: Application To Foundry Sand Reclamation | |
|---|---|
| Operating Conditions | |
| Flow-rate of Spent Foundry Sand | 60 kg/h |
| Natural Gas | 2.05 $m^3N/h$ |
| Air | 29 $m^3N/h$ |
| Solid Flux in the Riser Pipe | 35 $kg/m^2s$ |
| Inventory of Solids | 140 kg |
| Riser Temperature | 910–930° C. |
| Annular Bed Temperature | 780–820° C. |
| Exit Gas Temperature | 250° C. |
| Volume Fraction of Solid in the Riser | 2% |
| Initial Resin Concentration | 2.2% (Wt) |
| Type of Sand | Silica Sand |
| Mean Particle Size | 180–190 μm, 181 μm ± 88.6 μm, Confidence: 88.6% |
| Operation Time | 6 hours |
| Treatment Results | |
| Resin removal | 99% |
| Foundry Sand Size Distribution | mean: 189 μm ± 81 μm, Confidence: 99.2% |
| Gaseous Emissions | $CO_2$: 6.7%, CO: 61 ppm, NOx: 48 ppm, $O_2$: 7.6%, Fines: <5%, Efficiency: 0.9991 |
| Specific Consumption | 0.4–0.2 kW.h/kg |
| Molding Properties | Excellent |

| Second example: Application To Incineration of De-inking sludge | |
|---|---|
| Operating Conditions | |
| Flow-rate of De-inking Sludge | 5 kg/h |
| Natural Gas | 1–1.5 $m^3N/h$ |
| Air | 28 $m^3N/h$ |
| Solid Flux in the Riser Pipe | 30 $kg/m^2s$ |
| Inventory of Solids | 100 kg |
| Riser Temperature | 900–950° C. |
| Annular Bed Temperature | 850–920° C. |
| Exit Gas Temperature | 380° C. |

-continued

| | |
|---|---|
| Volume Fraction of Solid in the Riser | 3.1% |
| Initial Combustible Content | 40.2% (Wt) |
| Inert Content | 55.1% (Wt) |
| Moisture Content | 4.7% (Wt) |
| Type of Inert Material | Silica Sand and Kaolin |
| Mean Particle Size | 180–190 μm |
| Operation Time | 6 hours |
| Treatment Results | |
| Removal of Combustible Material | >97% |
| Gaseous Emissions | $CO_2$: 9.5%, CO: 201 ppm, NOx: 75 ppm, $O_2$: 3.3%, Fines: <10%, Efficiency: 0.99 |

The present invention presents, amongst others, the following advantages:

- the intimate contact between the flame produced by the burner 22 and the granular solid waste to be treated enables exploitation of the presence of a large quantity of oxidizing radicals in the flame to initiate degradation of the waste;
- the intimate contact between the flame produced by the burner 22 and the granular solid waste generates a treatment temperature ≧900° C. over the entire length of the riser pipe 52. The temperature in the riser pipe 52 can raise to values as high as 1 300–1 400° C. if a natural gas burner is used. With an oxygen/gas burner, air is replaced by oxygen and a temperature as high as 1 800° C. could be reached in the riser pipe 52. It is therefore possible to control the temperature in the riser pipe 52 in relation to the intended application in order to completely destroy all the organic compounds;
- the high velocity and the high turbulence in the riser pipe 52 cause very high heat and mass transfer coefficients;
- control of the residence time of the granular solid waste in the annular chamber 24, in the central zone 76, and more globally in the incinerator 13, through control of i) the above mentioned parameters determining the rate of flow and the mean number of flow cycles repeated by the granular solid waste, ii) the rate of flow of the granular solid waste supplied to the incinerator 13, and iii) the level (height) of the granular solid waste and bed material in the annular chamber 24;
- a high thermal inertia and the possibility of pre-drying the granular solid waste in the annular chamber 24 enables application of the present invention to granular solid waste having a high humidity contents such as sludge;
- granular solid waste having a high or low ash contents can be treated, ash constituting the bed if the ash contents of the waste is sufficiently high and sand or other inert granular material constituting the bed when the ash contents is low.

The limits of the present invention are principally those inherent to the fluidized beds.

Solid waste formed of particles of large and heterogeneous diameters must be reduced to a relatively fine granular waste having a homogeneous particle-size distribution.

In certain applications, removal of the residues contained in the granular bed material can be troublesome.

Erosion of the materials of which the incinerator 13 is made can be relatively fast depending on the nature of the transport fluid and waste.

The presence of solid waste particles that have a low melting point or that can agglomerate can adversely affect the flow of granular solid waste and bed material in the incinerator 13. The presence in the bed of materials having a low melting point such as alkaline metals, alkaline-earth metals under the form of oxides or halides, and certain salts may cause such agglomerations. Additives reacting with these materials can be used to raise the melting point thereof and prevent agglomeration.

For energy efficiency purposes, recovery of heat from the two effluents, the flue gas and the collected granular high temperature thermally treated solid waste, should be implemented. Conventional techniques can be used to recover this heat. For example, the recovered heat could be used to pre-heat the oxidizing agent (air) supplied to the burner 22 or to pre-heat the granular solid waste to be treated.

To complete the installation, a more efficient system for recovering the fine particles present in the flue gas could be installed, for example a baghouse filter, a precipitator filter, a wire gauze filter, a ceramic filter, or an electrostatic precipitator.

Finally, it could be necessary to install in certain applications a system for post-treating the flue gas such as a rapid or catalytic combustion, or a contaminant absorption or adsorption system.

Moreover, it should be reminded that a treatment according to the present invention may comprise:

- elimination of contaminants through combustion;
- regeneration of solid waste;
- burning a first portion of the solid waste to recover a usable second portion;
- any other treatment in view of valorizing the solid waste.

Examples of applications of the present invention are the following:

a) Industrial solid waste (hazardous or not), for example spent foundry sand;

b) Contaminated soil, for examples soil contaminated with PCB;

c) Process sludges such as pulp and paper de-inking sludge, sludges from municipal or industrial waste water treatment plants, sludges from laundry plants, sludges considered as hazardous waste such as refinery petroleum sludges, etc.;

d) Spent potlining and anode from the aluminum electrolysis;

e) Paint sludge;

f) Other industrial sludge;

g) Other Divided Solid Wastes with low heating value; etc.

Industrial solid waste and contaminated soil can be more or less humid but must be relatively well comminuted to be treated in an incinerator installation in accordance with the present invention.

Semi-solid or semi-liquid sludges can be treated without prior drying provided that they have been filtered to increase the dry solid content to a value of about 30–40% and thereby obtain a satisfying energetic performance; otherwise most of the energy is used to evaporate water. The objective is to eliminate the sludges but the non combustible inert portion thereof can be recovered; for example the clay contents of paper de-inking sludges can be recovered for use in the manufacture of paper.

Although the present invention has been described hereinabove by way of a preferred embodiment thereof, this embodiment can be modified at will, within the scope of the appended claims, without departing from the spirit and nature of the subject invention.

What is claimed is:

1. A process for thermally treating granular solid waste in an incinerator installation comprising i) a generally vertical riser pipe having an inside, an upper end, and a lower portion, ii) a vertically extending chamber adjacent to the riser pipe, having a lower portion, and containing a bed of granular material, and iii) a burner for producing an upwardly extending flame in the lower portion of the riser pipe and flue gas flowing upwardly in the riser pipe, said process comprising:

a) supplying said bed with untreated granular solid waste;

b) supplying granular solid waste and bed material from the lower portion of said chamber directly in the flame produced in the lower portion of the riser pipe;

c) by means of the flame produced by the burner, burning the granular solid waste and heating the inside of the riser pipe;

d) by means of the flue gas, pneumatically transporting the granular solid waste and bed material upwardly from the lower portion of the riser pipe to the upper end of said pipe so as to create turbulence in the riser pipe to thereby increase absorption of heat by the granular solid waste and oxidation of combustible components of the granular solid waste;

e) discharging the granular solid waste and bed material in said chamber through the upper end of the riser pipe; and f) evacuating the flue gas from the incinerator installation.

2. A process for thermally treating granular solid waste as recited in claim 1, further comprising collecting treated granular solid waste from said chamber.

3. A process for thermally treating granular solid waste as recited in claim 1, wherein:

supplying said bed with untreated granular solid waste comprises supplying, at a given flow rate, untreated granular solid waste to said bed; and said process further comprises collecting treated granular solid waste from said bed in order to maintain a level of granular solid waste and bed material substantially constant in said chamber.

4. A process for thermally treating granular solid waste as recited in claim 1, wherein supplying said bed with untreated granular solid waste comprises supplying untreated granular solid waste in said chamber on the top of the bed of granular material.

5. A process for thermally treating granular solid waste as recited in claim 1, wherein:

said chamber is generally annular and surrounds the riser pipe;

supplying granular solid waste and bed material from the lower portion of the annular chamber directly in the flame produced in the lower portion of the riser pipe causes a downward flow of granular solid waste and bed material in the annular chamber, and said process further comprises transferring heat from the inside of the riser pipe to the annular chamber to heat the granular solid waste as said granular solid waste flows downwardly in the annular chamber.

6. A process for thermally treating granular solid waste as recited in claim 1, wherein:

said chamber is generally annular and surrounds the riser pipe;

supplying granular solid waste and bed material from the lower portion of the annular chamber directly in the flame produced in the lower portion of the riser pipe causes a downward flow of granular solid waste and bed material in the annular chamber; and said process further comprises transferring heat from the inside of the riser pipe to the annular chamber to dry the untreated granular solid waste as said granular solid waste flows downwardly in said chamber.

7. A process for thermally treating granular solid waste as recited in claim 1, wherein supplying said bed with untreated granular solid waste comprises supplying untreated granular solid waste to the burner through a gas-supply line of said burner.

8. A process for thermally treating granular solid waste as recited in claim 1, wherein:

the riser pipe is generally cylindrical;

said chamber is generally annular and surrounds the riser pipe;

the lower portion the riser pipe comprises orifices; and supplying granular solid waste and bed material from the lower portion of the annular chamber directly in the flame produced in the lower portion of the riser pipe comprises supplying through said orifices granular solid waste and bed material from the lower portion of the annular chamber directly in the flame produced in the lower portion of the riser pipe.

9. A process for thermally treating granular solid waste as recited in claim 8, further comprising fluidizing the bed of granular material.

10. A process for thermally treating granular solid waste as recited in claim 1, wherein heating the inside of the riser pipe comprises heating the inside of the riser pipe to a temperature greater than or equal to 900° C.

11. A process for thermally treating granular solid waste as recited in claim 1, wherein pneumatically transporting the granular solid waste and bed material comprises pneumatically transporting the granular solid waste and bed material upwardly at a speed between 3 and 15 meters/second.

12. A process for thermally treating granular solid waste as recited in claim 1, wherein pneumatically transporting the granular solid waste and bed material further comprises producing in the riser an upward flow containing between 1% and 5% by volume of granular solid waste and bed material to further increase turbulence in the riser pipe.

* * * * *